US010699841B2

(12) United States Patent
Hashimoto

(10) Patent No.: US 10,699,841 B2
(45) Date of Patent: Jun. 30, 2020

(54) WOUND COIL

(71) Applicant: Murata Manufacturing Co., Ltd., Kyoto-fu (JP)

(72) Inventor: Ryota Hashimoto, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 306 days.

(21) Appl. No.: 15/967,194

(22) Filed: Apr. 30, 2018

(65) Prior Publication Data

US 2018/0342346 A1 Nov. 29, 2018

(30) Foreign Application Priority Data

May 23, 2017 (JP) ..... 2017-101328

(51) Int. Cl.

| | |
|---|---|
| ***H01F 27/24*** | (2006.01) |
| ***H01F 27/29*** | (2006.01) |
| ***H01F 27/28*** | (2006.01) |
| ***H01F 3/10*** | (2006.01) |
| ***H01F 17/04*** | (2006.01) |

(52) U.S. Cl.

CPC ..... *H01F 27/29* (2013.01); *H01F 3/10* (2013.01); *H01F 17/045* (2013.01); *H01F 27/24* (2013.01); *H01F 27/2823* (2013.01); *H01F 27/2828* (2013.01); *H01F 27/292* (2013.01)

(58) Field of Classification Search

CPC ..... H01F 27/24–29; H01F 27/00–36; H01M 2/10

USPC ..... 336/65, 83, 192, 196–198, 200, 232

See application file for complete search history.

(56) References Cited

U.S. PATENT DOCUMENTS 6,326,874 B1 * 12/2001 Banzi, Jr. ..... H01F 5/04 336/192
2017/0011843 A1 * 1/2017 Mikogami ..... H01F 27/2828

FOREIGN PATENT DOCUMENTS

| | | | |
|---|---|---|---|
| JP | 10135048 A | * | 5/1998 |
| JP | H10135048 A | | 5/1998 |
| JP | 2007012861 A | | 1/2007 |
| JP | 2015-032761 A | | 2/2015 |

OTHER PUBLICATIONS

An Office Action; "Notification of Reasons for Refusal," Mailed by the Japanese Patent Office dated Aug. 13, 2019, which corresponds to Japanese Patent Application No. 2017-101328 and is related to U.S. Appl. No. 15/967,194; with English language translation.

* cited by examiner

*Primary Examiner* — Tuyen T Nguyen
(74) *Attorney, Agent, or Firm* — Studebaker & Brackett PC

(57) ABSTRACT

A wound coil comprises terminal electrodes. Each of the terminal electrodes includes a bottom portion extending over a bottom surface of a flange from a ridge at which the bottom surface and an outer end surface of the flange cross each other, and an outer portion extending over the outer end surface from the ridge. The flange includes a recess between adjacent ones of the terminal electrodes. An outer end portion of the recess that is closer to the outer end surface is located in the outer end surface. An inner end portion of the recess that is closer to the inner end surface is located in the bottom surface, or located at a portion in the inner end surface closer to the bottom surface, than the outer end portion of the recess.

12 Claims, 7 Drawing Sheets

WOUND COIL

CROSS-REFERENCE TO RELATED APPLICATION

This application claims benefit of priority to Japanese Patent Application No. 2017-101328, filed May 23, 2017, the entire content of which is incorporated herein by reference.

BACKGROUND

Technical Field

The present disclosure relates to a wound coil, and particularly, to a wound coil including a drum core including a wound core and a flange disposed at an end portion of the wound core.

Background Art

A wound coil in which the present disclosure has an interest is described in, for example, Japanese Unexamined Patent Application Publication No. 2015-32761. FIG. 9 refers to FIG. 1 of Japanese Unexamined Patent Application Publication No. 2015-32761. FIG. 9 shows the external appearance of a wound common mode choke coil 1, as an example of a wound coil.

As illustrated in FIG. 9, the wound common mode choke coil 1 includes a drum core 2, and first and second wires 3 and 4, each forming an inductor. The drum core 2 includes a wound core 5 and first and second flanges 6 and 7, at both end portions of the wound core 5. The first and second wires 3 and 4 are helically wound around the wound core 5 substantially the same number of turns from an end portion closer to the first flange 6 toward an end portion closer to the second flange 7.

Two first terminal electrodes 8 and 9 are disposed on the first flange 6. Two second terminal electrodes 10 and 11 are disposed on the second flange 7. As is clear from the positions of the terminal electrodes 8 to 11, FIG. 9 illustrates the wound common mode choke coil 1 in the position having a mount surface, which is to be oriented toward a mount substrate, facing upward.

The first wire 3 has both end portions connected to the first terminal electrode 8 and the second terminal electrode 10. The second wire 4 has both end portions connected to the first terminal electrode 9 and the second terminal electrode 11.

SUMMARY

Consideration can be given to the forms of the flanges 6 and 7 of the above wound common mode choke coil 1 on which the terminal electrodes 8 to 11 are disposed. The first flange 6 includes a recess 12 between the terminal electrodes 8 and 9. The second flange 7 includes a recess 13 between the terminal electrodes 10 and 11. These recesses 12 and 13 secure electrical isolation between the terminal electrodes 8 and 9 and electrical isolation between the terminal electrodes 10 and 11.

In the wound common mode choke coil 1 having the above structure, the height Ha of the terminal electrodes 8 to 11 affects the shape of a fillet formed to solder-mount the common mode choke coil 1. Specifically, the terminal electrodes 8 to 11 having a height Ha of less than a certain height hinder formation of a fillet having a smoothly curved surface.

In addition, the terminal electrodes 8 to 11 having a greater height Ha further increase the contact area between the terminal electrodes 8 to 11 and the flanges 6 and 7. This structure can enhance the bonding strength of the terminal electrodes 8 to 11 on the flanges 6 and 7.

As described above, the terminal electrodes 8 to 11 having a greater height Ha are expected to have some advantages. However, when looked from the other point of view, the wound common mode choke coil 1 illustrated in FIG. 9 including the terminal electrodes 8 to 11 having a great height Ha includes deep recesses 12 and 13. Forming the deep recesses 12 and 13 in the wound common mode choke coil 1 whose size is limited reduces the strength of the drum core 2. The height Ha of the terminal electrodes 8 to 11 is thus usually limited to a certain upper limit.

In the structure illustrated in FIG. 9, even the strength of the drum core 2 is disregarded, the terminal electrodes 8 to 11 cannot have a greater height Ha than the wound core 5. This is because each of the terminal electrodes 8 to 11 having a greater height Ha than the wound core 5 may be short-circuited with the other one of the terminal electrodes 8 to 11 at portions near the wound core 5. Even the terminal electrodes 8 to 11 having a lower height Ha than the wound core 5 have a higher risk of solder adhering to wires when the wound coil is mounted on the mount substrate, as the height Ha is closer to that of the wound core 5. Thus, the terminal electrodes 8 to 11 need to have a height Ha not excessively high but with which they are sufficiently spaced from the wound core 5.

Not only a wound common mode choke coil, other wound coils, such as a wound chip transformer, including multiple terminal electrodes at flange can have similar problems.

Accordingly, the present disclosure provides a wound coil including a terminal electrode having a greater height at a portion affecting a formation of a fillet and including a drum core retaining its strength.

According to preferred embodiments of the present disclosure, a wound coil includes a drum core including a wound core and a flange disposed at an end portion of the wound core; terminal electrodes disposed on the flange; and a plurality of wires each wound around the wound core and each connected to one of the terminal electrodes. The flange includes an inner end surface facing the wound core and on which the end portion of the wound core is disposed, and an outer end surface opposite to the inner end surface and facing outward. The flange further includes a bottom surface coupling the inner end surface to the outer end surface, and oriented toward a mount substrate when the wound coil is mounted on the mount substrate, a top surface opposite to the bottom surface, and a pair of side surfaces opposite to each other and extending in such a direction as to couple the bottom surface to the top surface.

The terminal electrodes are arranged in a direction in which a ridge of the flange at which the bottom surface and the outer end surface cross each other extends. In a wound coil according to an embodiment of the present disclosure, each of the terminal electrodes includes a bottom portion that extends over the bottom surface from the ridge, and an outer portion that extends over the outer end surface from the ridge.

The flange includes a recess between adjacent ones of the terminal electrodes. An outer end portion of the recess that is closer to the outer end surface is located in the outer end surface. An inner end portion of the recess that is closer to the inner end surface is located in the bottom surface or located at a portion in the inner end surface closer to the bottom surface than the outer end portion of the recess.

The above structure enables formation of a deeper recess in the outer end surface of a flange, than that described in Japanese Unexamined Patent Application Publication No. 2015-32761 without significantly reducing the strength of the drum core. This structure thus enables an extension of the outer portions over the outer end surfaces of the multiple terminal electrodes arranged on the flange while the outer portions are spaced apart from each other by the recess.

An end portion of the bottom portion of each of the terminal electrodes may be located in the bottom surface. Also, the inner end portion of the recess may be located in the bottom surface, and an area of the bottom surface closer to the inner end surface may form a flat surface.

When the wound coil having this structure is mounted on the mount substrate, the flat surfaces are allowed to be in contact or located close to the mount substrate. When, for example, a moistureproof coating agent is applied to the wound coil mounted on the mount substrate, this structure hinders the coating agent from passing through the gap between the flanges and the mount substrate. If the coating agent repeatedly expands and contracts while being in contact with the wires, the coating agent may damage the wires to, for example, break the wires. The above structure can prevent such possible damages.

In preferred embodiments of the present disclosure, when each of the terminal electrodes is viewed in a direction perpendicular to the side surfaces, a ratio of a extending dimension of the outer portion of the terminal electrode to a extending dimension of the bottom portion of the terminal electrode is smaller than or equal to about 93%. This structure enhances the mass productivity of wound coils during formation of terminal electrodes through an application of an electroconductive paste by dipping.

In another embodiment of the present disclosure, each of the terminal electrodes may further include an inner portion extending over the inner end surface from the bottom portion of the terminal electrode. The inner end portion of the recess is located in the inner end surface. This structure increases the area of the terminal electrodes in contact with the flanges, and thus can enhance the fixing strength of the terminal electrodes with which they are fixed to the flanges.

In the above-described embodiment, when each of the terminal electrodes is viewed in a direction perpendicular to the side surfaces, a extending dimension of the inner portion of the terminal electrode may be shorter than a extending dimension of the outer portion of the terminal electrode. To retain the strength of the drum core, when the wound coil is viewed in a direction perpendicular to the side surfaces of each of the flanges, a dimension of an area of the opening defined by the recess extending over part of the inner end surface across the bottom surface may be shorter than a dimension of an area of the opening extending over part of the outer end surface across the bottom surface.

In the above-described embodiment, when each of the terminal electrodes is viewed in a direction perpendicular to the side surfaces, an end portion of the inner portion of each of the terminal electrodes may be located outward of outer peripheral of the wires in a wound state. This structure hinders an unintended contact between the wires and the terminal electrodes.

In preferred embodiments of the present disclosure, the recess is defined by a pair of inner side surfaces, facing each other and perpendicular to the bottom surface and the outer end surface, and an inner bottom surface, coupling the pair of inner side surfaces.

In the above structure, each of the terminal electrodes further includes an inner side portion extending over the inner side surface of the recess. The inner side surfaces are separated by the inner bottom surface. Thus, the terminal electrodes can be disposed on the inner side surfaces while being prevented from being short-circuited between each other. The terminal electrodes located at outermost further includes a side portion extending over the side surface of the flange. These structures increase the area of the terminal electrodes in contact with the flanges, and thus can enhance the fixing strength of the terminal electrodes with which they are fixed to the flanges.

In the above-described embodiments, typically, the inner side portions of the terminal electrodes are triangular, and the side portions of the terminal electrodes are triangular.

In the above-described embodiments, the inner bottom surface of each recess may be a flat and oblique surface to the bottom surface or a surface set back inward. The surface set back inward may be a concave surface or a surface bent inward. Either surface can hinder terminal electrodes, formed through an application of an electroconductive paste by dipping, from being short-circuited between each other.

In an embodiment of the present disclosure, as appropriate, when the wound coil is viewed in a direction perpendicular to the side surfaces, an extending dimension of the outer portion of each of the terminal electrodes may be longer than a distance from the bottom surface of the flange to the wound core. Selecting the above dimension relationship enables an increase of the height of the terminal electrodes at the outer portions affecting the formation of fillets without reducing the strength of the drum core and without affecting the height of the wound core from the mount surface.

In preferred embodiments of the present disclosure, to more securely form a fillet having a smoothly curved surface, when the wound coil is viewed in a direction perpendicular to the side surfaces, a extending dimension of the outer portion of each of the terminal electrodes may be longer than or equal to about 0.5 mm.

Preferred embodiments of the present disclosure may include a terminal electrode having a multilayer structure including, as a base, a baked layer formed through an application and baking of an electroconductive paste, and at least one plating film on the baked layer. The above-described position, shape, and dimensions of the terminal electrode are defined on the basis of the baked layer serving as a base, without considering the plating film.

Preferred embodiments of the present disclosure can increase the height of the terminal electrodes at at least the outer portions that affect formation of fillets without reducing the strength of the drum core. The increase of the height of the terminal electrodes increases the area of the terminal electrodes over which they are in contact with the flanges, and thus can enhance the fixing strength of the terminal electrodes on the flanges. While the wound coil is being solder-mounted onto the mount substrate, a fillet having a smoothly curved surface is formed, which enhances the reliability of image recognition. This structure can facilitate automatic recognition of whether the wound coil is appropriately mounted.

Other features, elements, characteristics and advantages of the present disclosure will become more apparent from the following detailed description of preferred embodiments of the present disclosure with reference to the attached drawings.

DETAILED DESCRIPTION

A wound coil 21 according to a first embodiment of the present disclosure is described with reference to FIG. 1 to FIG. 5. The wound coil 21 forms a common mode choke coil.

Figure 1:
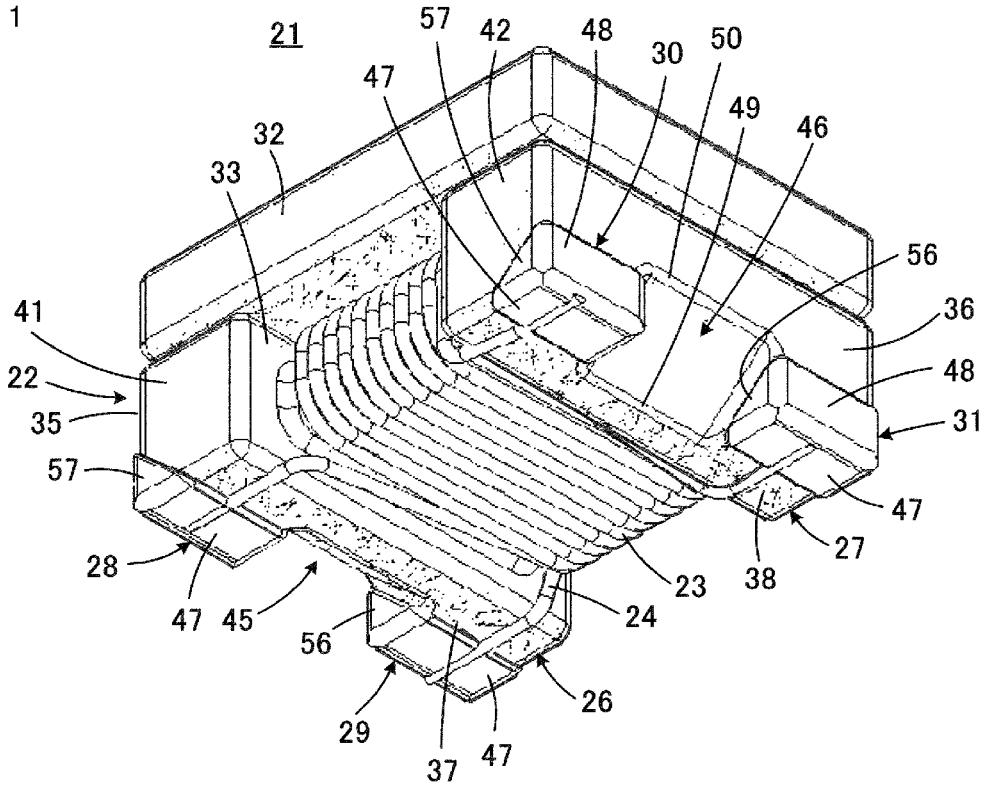
FIG. 1 is a perspective view of a wound coil according to a first embodiment of the present disclosure, illustrating the surface oriented toward a mount substrate.
Figure 2:
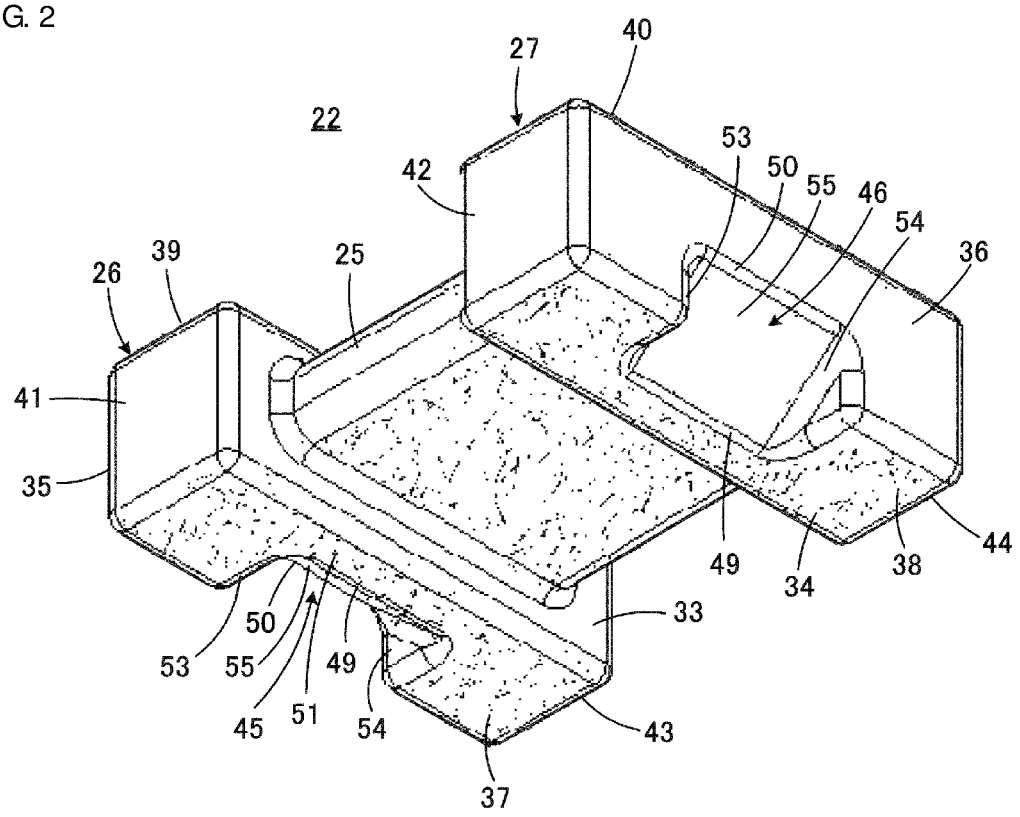
FIG. 2 is a perspective view of only a drum core of the wound coil illustrated in FIG. 1.

As illustrated in FIG. 1, the wound coil 21 includes a drum core 22, and a first wire 23 and a second wire 24, each of which forms an inductor. The drum core 22 is made of an electrically insulating material, more specifically, a material such as alumina, an example of a dielectric, Ni—Zn ferrite, an example of a magnetic substance, or a resin. As illustrated in FIG. 2 in detail, the drum core 22 has a rounded quadrangular section as a whole. The wires 23 and 24 are made of, for example, insulation coated copper wires.

As illustrated in FIG. 2 in detail, the drum core 22 includes a wound core 25, and a first flange 26 and a second flange 27, disposed at end portions of the wound core 25. The first and second wires 23 and 24 are helically wound around the wound core 25 substantially the same number of turns from one end portion closer to the first flange 26 toward the other end portion closer to the second flange 27.

Although not particularly illustrated in FIG. 1, one of the first and second wires 23 and 24 is wound around the peripheral surface of the wound core 25 to form a first layer. The other one of the first and second wires 23 and 24 is wound around the first layer to form a second layer while having its part in a cross section being fitted into a gap, formed between adjacent turns of the wire forming the first layer. Here, the first and second wires 23 and 24 may be wound around the wound core 25 while being adjacent to each other to form a bifilar coil, wound around the wound core 25 at separate portions, or wound to additionally form at least a third layer. The form in which the first and second wires 23 and 24 are wound is not limited to a particular one.

Figure 3:
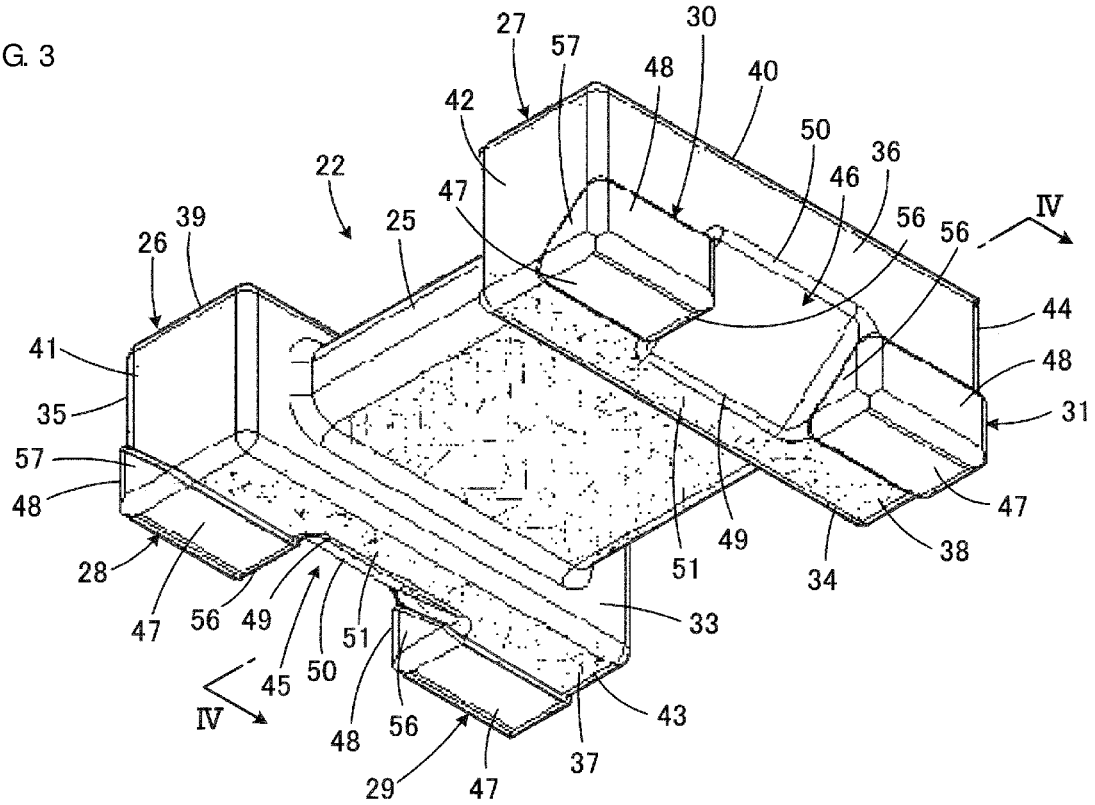
FIG. 3 is a perspective view of the drum core illustrated in FIG. 2 on which terminal electrodes are disposed.

As illustrated in FIG. 3 in detail, two first terminal electrodes 28 and 29 are disposed on the first flange 26, and two second terminal electrodes 30 and 31 are disposed on the second flange 27. As is clear from the positions of the terminal electrodes 28 to 31, FIG. 1 to FIG. 3 illustrate the wound coil 21 or the drum core 22 in such a position as to show the surface oriented toward a mount substrate. The terminal electrodes 28 to 31 are formed by, for example, baking an electroconductive paste containing Ag as an electroconductive component. Then, as needed, for example, the terminal electrodes 28 to 31 are sequentially subjected to Ni plating and Sn plating. For example, a film of Ni plating has a thickness of approximately 3 μm, and a film of Sn plating has a thickness of approximately 10 μm.

The baked layers forming the above terminal electrodes 28 to 31 may be formed from an electroconductive paste containing Cu as an electroconductive component, instead of Ag. The films of plating disposed on the baked layers may be formed in order of copper, nickel, and tin plating or nickel, copper, and tin plating. In some cases, films of palladium and gold plating may be formed as outermost layers. The flanges 26 and 27 and the terminal electrodes 28 to 31 are described in detail below.

The first wire 23 has both end portions connected to the first terminal electrode 28 and the second terminal electrode 30. The second wire 24 has both end portions connected to the first terminal electrode 29 and the second terminal electrode 31. These connections are performed by, for example, thermocompression bonding.

As illustrated in FIG. 1, the wound coil 21 also includes a plate core 32. The plate core 32 is bonded to the drum core 22 with an adhesive. As in the case of the drum core 22, the plate core 32 is made of, for example, a material such as alumina, an example of a dielectric, Ni—Zn ferrite, an example of a magnetic substance, or a resin. When the drum core 22 and the plate core 32 are both made of a magnetic substance, the drum core 22 forms a closed magnetic circuit in cooperation with the plate core 32, disposed to couple the first flange 26 and the second flange 27 together. The plate core 32 is not an essential component.

Figure 4:
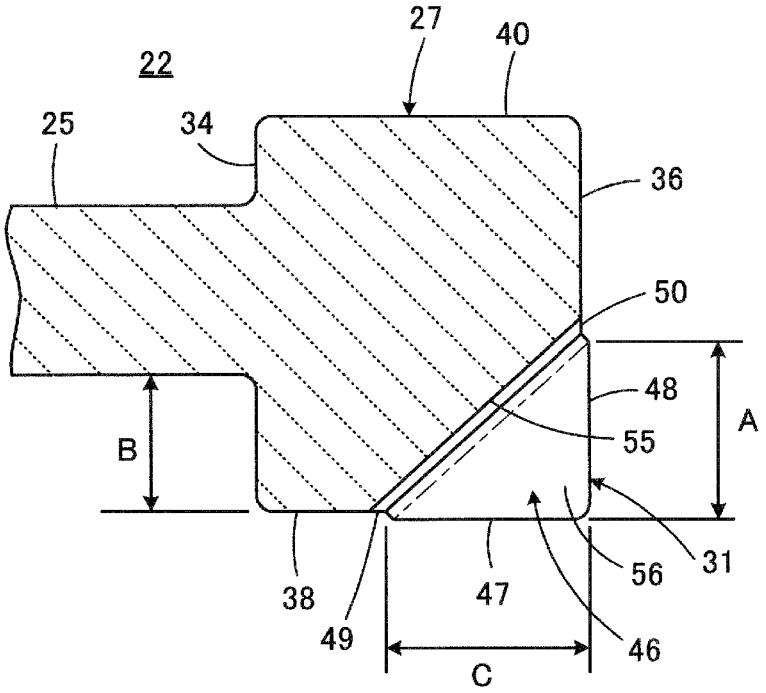
FIG. 4 is an enlarged sectional view of part of the drum core illustrated in FIG. 3 on which one terminal electrode is disposed, taken along line IV-IV of FIG. 3.

With reference to FIG. 2 to FIG. 4 and other drawings, the flanges 26 and 27 and the terminal electrodes 28 to 31 are described in detail below.

The flanges 26 and 27 respectively include inner end surfaces 33 and 34, facing the wound core 25 and on which the end portions of the wound core 25 are disposed, outer end surfaces 35 and 36, opposite to the inner end surface 33 and 34 and facing outward, bottom surfaces 37 and 38, oriented toward a mount substrate (not illustrated) when the wound coil 21 is mounted on the mount substrate, top surfaces 39 and 40 opposite to the bottom surfaces 37 and 38, first side surfaces 41 and 42, and second side surfaces 43 and 44 opposite to the first side surfaces 41 and 42.

The bottom surface 37, the top surface 39, the first side surface 41, and the second side surface 43 of the first flange 26 couple the inner end surface 33 and the outer end surface 35 to each other. The first side surface 41 and the second side surface 43 extend in such a direction as to couple the bottom surface 37 and the top surface 39 to each other.

Similarly, the bottom surface 38, the top surface 40, the first side surface 42, and the second side surface 44 of the second flange 27 couple the inner end surface 34 and the outer end surface 36 to each other. The first side surface 42 and the second side surface 44 extend in such a direction as to couple the bottom surface 38 and the top surface 40 to each other.

The two first terminal electrodes 28 and 29 are arranged to extend in a direction in which a ridge of the first flange 26 at which the bottom surface 37 and the outer end surface 35 cross each other extends. The two second terminal electrodes 30 and 31 are arranged to extend in a direction in which a ridge of the second flange 27 at which the bottom surface 38 and the outer end surface 36 cross each other extends.

The first flange 26 includes a recess 45 between the adjacent two first terminal electrodes 28 and 29. The second flange 27 includes a recess 46 between the adjacent two second terminal electrodes 30 and 31.

In the following description, the reference signs denoting the portions of the terminal electrodes 28 to 31 are the same between the terminal electrodes 28 to 31, and the reference signs denoting the portions of the recesses 45 and 46 are the same between the recesses 45 and 46.

Each of the first terminal electrodes 28 and 29 includes a bottom portion 47 extending over part of the bottom surface 37 and an outer portion 48 extending over part of the outer end surface 35 from a ridge of the first flange 26 at which the bottom surface 37 and the outer end surface 35 cross each other. Each of the second terminal electrodes 30 and 31 also includes a bottom portion 47 extending over part of the bottom surface 38 and an outer portion 48 extending over part of the outer end surface 36 from a ridge of the second flange 27 at which the bottom surface 38 and the outer end surface 36 cross each other.

In the first flange 26, an inner end portion 49 of the recess 45 that is closer to the inner end surface 33 is located in the bottom surface 37, and an outer end portion 50 of the recess 45 that is closer to the outer end surface 35 is located in the outer end surface 35. When the drum core 22 is in the position illustrated in FIG. 1 to FIG. 4, the inner end portion 49 of the recess 45 closer to the inner end surface 33 is located lower than the outer end portion 50 of the recess 45 closer to the outer end surface 35 (closer to the mount substrate).

Similarly, in the second flange 27, an inner end portion 49 of the recess 46 closer to the inner end surface 34 is located in the bottom surface 38, and an outer end portion 50 of the recess 46 closer to the outer end surface 36 is located in the outer end surface 36. When the drum core 22 is in the position illustrated in FIG. 1 to FIG. 4, the inner end portion 49 of the recess 46 closer to the inner end surface 34 is located lower than the outer end portion 50 of the recess 46 closer to the outer end surface 36 (closer to the mount substrate).

What significantly affects the strength of the drum core 22 is the depth of the recesses 45 and 46 in the inner end surfaces 33 and 34. The inner end portions 49 located lower than the outer end portions 50 enable the recesses 45 and 46 to have a large depth in the outer end surfaces 35 and 36 of the flanges 26 and 27 without significantly reducing the strength of the drum core 22. This embodiment can determine the height (depth of the recesses 45 and 46) of the inner end portions 49 of the recesses 45 and 46 closer to the inner end surfaces 33 and 34 independently of the height of the outer end portions 50 closer to the outer end surfaces 35 and 36. Thus, the outer portions 48 of the terminal electrodes 28 to 31 extending over part of the outer end surfaces 35 and 36 on the flanges 26 and 27 can be extended while being spaced apart from each other by the recesses 45 and 46.

Particularly, in this embodiment, as described above, the inner end portions 49 of the areas of openings defined by the recesses 45 and 46, the areas extending over the bottom surfaces 37 and 38, are on the bottom surfaces 37 and 38. Thus, the areas of the bottom surfaces 37 and 38 near the inner end surfaces 33 and 34 form flat surfaces 51.

In this structure, when the wound coil 21 is mounted on the mount substrate, the flat surfaces 51 can be substantially in contact with or located close to the mount substrate. When the wound coil 21 mounted on the mount substrate has, for example, a moistureproof coating agent applied thereto, the coating agent is hindered from passing through the gap between the flanges 26 and 27 and the mount substrate. A coating agent may expand or contract due to changes of the conditions in which the mount substrate is placed, such as under the blazing sun or subzero temperatures. If the coating agent repeatedly expands and contracts while being in contact with the wires 23 and 24, the coating agent may damage the wires 23 and 24 to, for example, break the wires 23 and 24. The above structure can prevent such possible damages.

The wound coil 21 also has the following characteristics.

The recess 45 is defined by a pair of inner side surfaces 53 and 54, facing each other and perpendicular to the bottom surface 37 and the outer end surface 35, and an inner bottom surface 55, coupling the pair of inner side surfaces 53 and 54 together. The recess 46 is defined by a pair of inner side surfaces 53 and 54, facing each other and perpendicular to the bottom surface 38 and the outer end surface 36, and an inner bottom surface 55, coupling the pair of inner side surfaces 53 and 54 together.

The first terminal electrodes 28 and 29 include inner side portions 56, which extend over the inner side surfaces 53 and 54 of the recess 45. The second terminal electrodes 30 and 31 include inner side portions 56, which extend over the inner side surfaces 53 and 54 of the recess 46. The terminal electrodes located at outermost, specifically, the terminal electrodes 28 to 31 include side portions 57, which extend over part of the side surfaces 41 to 44 of the flanges 26 and 27, opposite to the inner side surfaces 53 and 54 of the recesses 45 and 46.

The above structure can increase the area of the terminal electrodes 28 to 31 in contact with the flanges 26 and 27, and thus enhance the fixing strength of the terminal electrodes 28 to 31 with which they are fixed to the flanges 26 and 27. This structure can also increase the area of the terminal electrodes 28 to 31 in contact with the solder when the wound coil 21 is mounted on the mount substrate. Thus, when the wound coil 21 is mounted on the mount substrate, this structure can enhance the fixing strength of the terminal electrodes 28 to 31 with which they are fixed to the solder, and thus enhance the fixing strength of the terminal electrodes 28 to 31 with which they are fixed to the mount substrate.

In this embodiment, due to the method for forming the terminal electrodes 28 to 31, described below, each of the inner side portions 56 of the terminal electrodes 28 to 31 extending over the inner side surfaces 53 and 54 of the recesses 45 and 46 forms a triangle, and each of the side portions 57 extending over part of the side surfaces 41 to 44 of the flanges 26 and 27, opposite to the inner side surfaces 53 and 54 of the recesses 45 and 46, forms a triangle. The inner bottom surfaces 55 of the recesses 45 and 46 are flat and oblique surfaces to the bottom surfaces 37 and 38.

Figure 9:
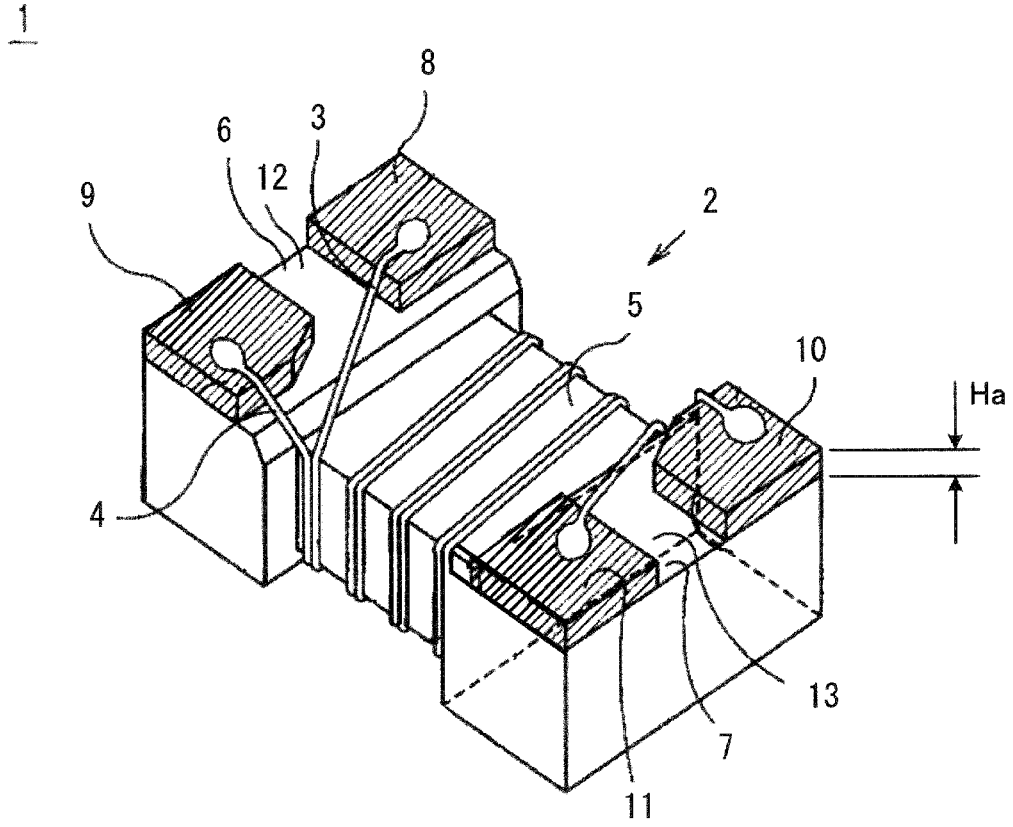
FIG. 9 is a perspective view, viewed from the bottom, of the appearance of a wound common mode choke coil, which is an example of a wound coil, cited from FIG. 1 of Japanese Unexamined Patent Application Publication No. 2015-32761.

With reference to FIG. 4, when the drum core 22 is viewed in a direction perpendicular to the side surfaces 41 to 44 of the flanges 26 and 27, the extending dimension A of each of the outer portions 48 of the terminal electrodes 28 to 31 extending over part of the outer end surfaces 35 and 36 is longer than the distance B from each of the bottom surfaces 37 and 38 of the flanges 26 and 27 to the wound core 25. Selecting such a dimensional relationship can increase the height of the terminal electrodes 28 to 31 at the portions that affect formation of a fillet. This structure is unachievable by the existing technology illustrated in FIG. 9. To more reliably form a fillet having a smoothly curved surface, preferably, the dimension A of each of the outer portions 48 of the terminal electrodes 28 to 31 extending over part of the outer end surfaces 35 and 36 is longer than or equal to about 0.5 mm, when the drum core 22 is viewed in a direction perpendicular to the side surfaces 41 to 44 of the flanges 26 and 27.

In the illustrated embodiment, the recesses 45 and 46 are each defined by the inner side surfaces 53 and 54 and the inner bottom surface 55. Instead, each recess may be formed by a curved surface without being clearly separated from the inner side surface and the inner bottom surface. When the recesses are formed by curved surfaces, the inner end portions 49 of the above recesses 45 and 46 closer to the inner end surfaces 33 and 34 and the outer end portions 50 of the above recesses 45 and 46 closer to the outer end surfaces 35 and 36 may appear in the form of dots instead of sides as illustrated.

Figure 5:
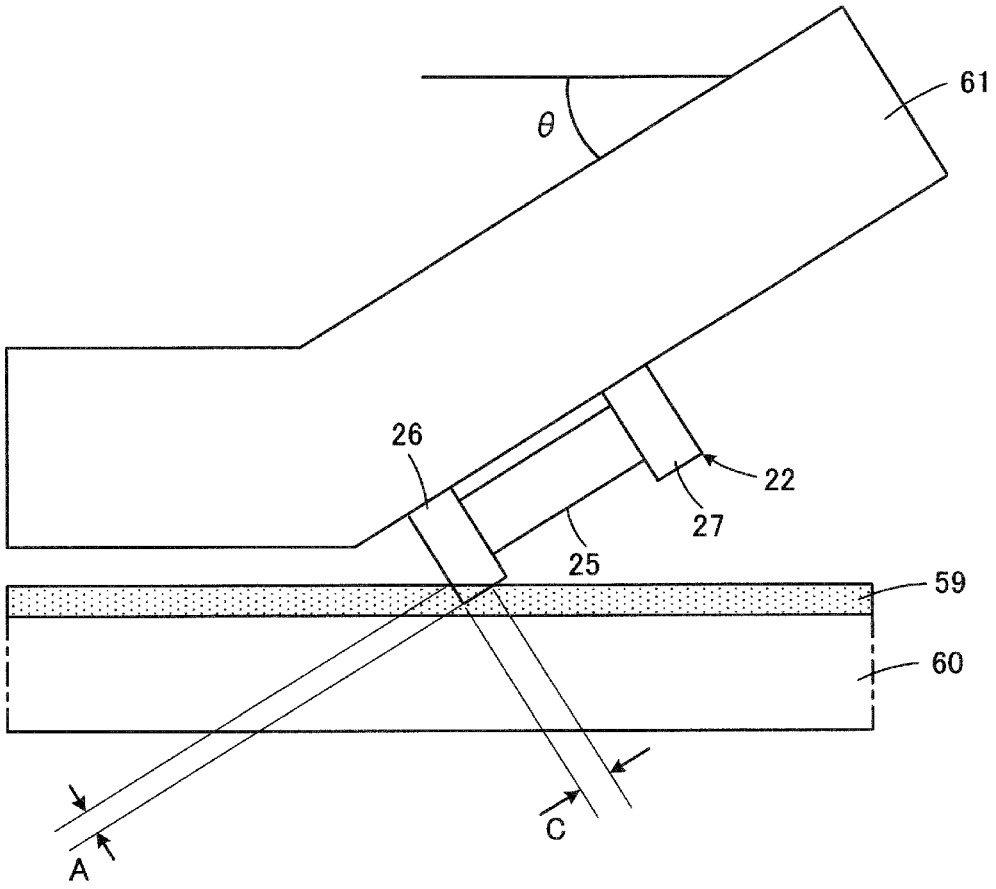
FIG. 5 illustrates a method for forming terminal electrodes on the wound coil illustrated in FIG. 1.

FIG. 5 illustrates a preferable method for forming the terminal electrodes 28 to 31 in the wound coil 21. As illustrated in FIG. 5, an applicator 60 is prepared to apply an electroconductive paste 59 to the drum core 22 by dipping. The applicator 60 has a plate shape. The applicator 60 holds the electroconductive paste 59 at a uniform thickness on its flat upper surface. A holder 61 holding the drum core 22 is disposed above the applicator 60. The drum core 22 is held by the holder 61 using, for example, adhesion.

To form the terminal electrodes 28 to 31 as illustrated in FIG. 1, FIG. 3, and FIG. 4, the drum core 22 held by the holder 61 is inclined at an angle θ of inclination with respect to the main surface of the applicator 60. The drum core 22 in this position is dipped into the electroconductive paste 59 and then raised. Thereafter, the electroconductive paste 59 undergoes a baking process.

As described above, each of the inner side portions 56 of the terminal electrodes 28 to 31 in the recesses 45 and 46 extending over the inner side surfaces 53 and 54 forms a triangle, and each of the side portions 57 of the recesses 45 and 46 extending over part of the side surfaces 41 to 44 of the flanges 26 and 27 opposite to the inner side surfaces 53 and 54 forms a triangle. This is because the drum core 22 is inclined when being dipped.

Here, in terms of mass productivity of the wound coil 21, more specifically, the efficiency in the process of forming the terminal electrodes 28 to 31, it has been found that the above angle of inclination θ is preferably smaller than or equal to 43 degrees. When the angle of inclination θ is smaller than or equal to 43 degrees, the ratio of the dimension A of each of the outer portions 48 of the terminal electrodes 28 to 31, extending over part of the outer end surfaces 35 and 36, to the dimension C of each bottom portion 47 of the terminal electrodes 28 to 31, extending over part of the bottom surfaces 37 and 38, is smaller than or equal to about 93%, when the drum core 22 is viewed in a direction perpendicular to the side surfaces 41 to 44 of the flanges 26 and 27.

Hereinbelow, other embodiments of the present disclosure are described.

Figure 6:
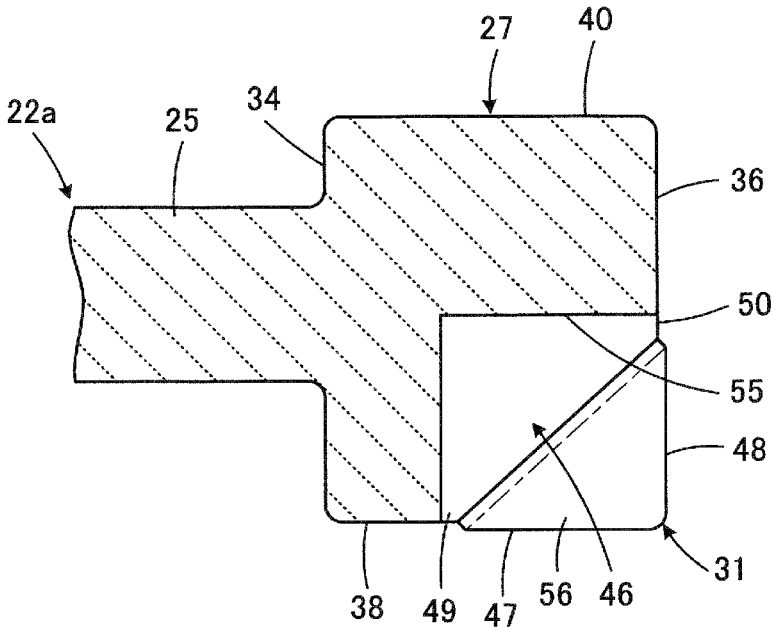
FIG. 6 corresponds to FIG. 4 and is an enlarged sectional view of part of a drum core of a wound coil according to a second embodiment of the present disclosure.
Figure 7:
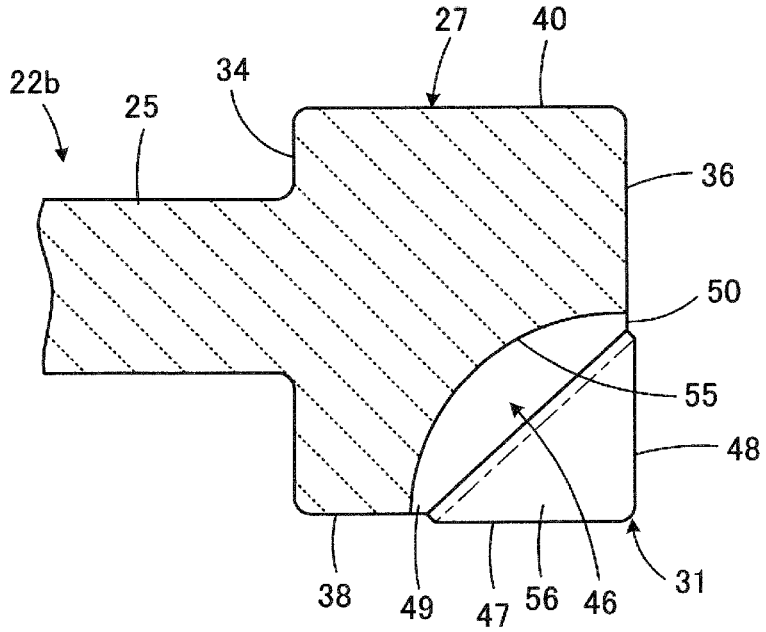
FIG. 7 corresponds to FIG. 4 and is an enlarged sectional view of part of a drum core of a wound coil according to a third embodiment of the present disclosure.
Figure 8:
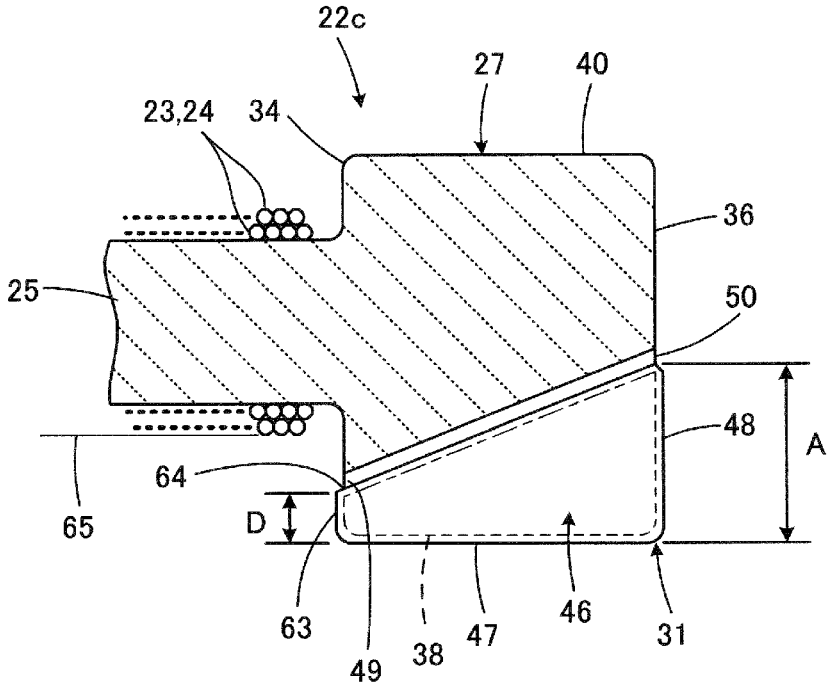
FIG. 8 corresponds to FIG. 4 and is an enlarged sectional view of part of a drum core of a wound coil according to a fourth embodiment of the present disclosure.

FIGS. 6 to 8 correspond to FIG. 4 and are enlarged sectional views of portions of drum cores 22*a*, 22*b*, and 22*c* of wound coils according to second, third, and fourth embodiments of the present disclosure. In FIGS. 6 to 8, components corresponding to the component illustrated in FIG. 4 are denoted with the same reference signs and not redundantly described.

As in the case of FIG. 4, FIGS. 6 to 8 illustrate the second flange 27, and the recess 46 and the second terminal electrode 31 disposed on the second flange 27. Thus, only the second flange 27 and the second terminal electrode 31 illustrated in FIGS. 6 to 8 are described below. Although not illustrated, the second terminal electrode 30 and the first flange 26 have the structures similar to those of the second terminal electrode 31 and the second flange 27.

With reference to FIG. 6, in the drum core 22*a*, the inner bottom surface 55 of the recess 46 is formed by the surface set back inward, more specifically, a surface bent inward. With reference to FIG. 7, in the drum core 22*b*, the inner bottom surface 55 of the recess 46 is formed by the surface set back inward, more specifically, a concave surface.

As in the above drum cores 22*a* and 22*b*, when the inner bottom surface 55 of the recess 46 is formed by the surface set back inward, the terminal electrode 30 and 31, formed through an application of an electroconductive paste by dipping, are less frequently short-circuited between each other by an extension of the electroconductive paste over the inner bottom surface 55.

With reference to FIG. 8, in the drum core 22*c*, the terminal electrode 31 includes an inner portion 63, which extends over the inner end surface 34 across the bottom surface 38 from a ridge of the flange 27 at which the bottom surface 38 and the outer end surface 36 cross each other (from the bottom portion 47 of the terminal electrode 31). The opening of the recess 46 has an area extending over part of the inner end surface 34 across the bottom surface 38 from the outer end surface 36. The inner end portion 49 of the recess 46 is located in the inner end surface 34.

This structure can increase the area of the terminal electrode 31 in contact with the flange 27, and thus can enhance the fixing strength of the terminal electrode 31 with which it is fixed on the flange 27. The area of the terminal electrode 31 and other components over which they are in contact with solder when the wound coil 21 is mounted on the mount substrate is increased. Thus, the fixing strength between the components such as the terminal electrode 31 and solder, and the fixing strength between the components such as the terminal electrode 31 and the mount substrate can be enhanced when the wound coil 21 is mounted on the mount substrate.

In this embodiment, the inner end portion 49 of the area of the opening defined by the recess 46, extending closer to the bottom surface 38, is located closer to the bottom surface 38 than is the outer end portion 50 of the area of the opening defined by the recess 46, extending closer to the outer end surface 36 in the inner end surface 34. Specifically, when the terminal electrode 31 is viewed in a direction perpendicular to the side surfaces 42 and 44 of the flange 27, the extending dimension D of the inner portion 63 of the terminal electrode 31, extending over part of the inner end surface 34 across the bottom surface 38, is shorter than the extending dimension A of the outer portion 48, extending over part of the outer end surface 36 from the ridge portion at which the bottom surface 38 and the outer end surface 36 cross each other. When the drum core 22*c* is viewed in a direction perpendicular to the side surfaces 42 and 44 of the flange 27, the dimension of the area in the opening defined by the recess 46 and extending over part of the inner end surface 34 across the bottom surface 38 is shorter than the dimension of the area extending over part of the outer end surface 36 from the ridge portion at which the bottom surface 38 and the outer end surface 36 cross each other, to prevent reduction of the strength of the drum core 22*c*.

In this embodiment, when the terminal electrode 31 is viewed in a direction perpendicular to the side surfaces 42 and 44 of the flange 27, the inner portion 63 of the terminal electrode 31 extending over part of the inner end surface 34 across the bottom surface 38 has an end portion 64 located outward from outer peripheral 65 of the wound wires 23 and 24 (that is, located below in the drawing or closer to the mount substrate). This structure hinders an unintended contact between the wires 23 and 24 and the terminal electrode 31.

Thus far, the present disclosure has been described using common mode choke coils according to some embodiments. The present disclosure, however, is also applicable to a wound chip transformer.

In preferred embodiments of the present disclosure, the number of wires and the number of terminal electrodes are determined as appropriate. For example, three or more wires may be included, and three or more terminal electrodes may be disposed on one flange. This structure includes multiple recesses, which may have the same shape or different shapes. In the above-described embodiments, the recess 45 in the first flange 26 and the recess 46 in the second flange 27 may have different shapes.

The embodiments illustrated in the drawings are mere examples. Some of the components may be exchanged or combined between different embodiments.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A wound coil, comprising:

a drum core including a wound core and a flange disposed at an end portion of the wound core;

terminal electrodes disposed on the flange; and a plurality of wires each wound around the wound core and each connected to one of the terminal electrodes, wherein the flange includes an inner end surface facing the wound core and on which the end portion of the wound core is disposed, an outer end surface opposite to the inner end surface and facing outward, a bottom surface coupling the inner end surface to the outer end surface, and oriented toward a mount substrate when the wound coil is mounted on the mount substrate, a top surface opposite to the bottom surface, and a pair of side surfaces opposite to each other and extending in such a direction as to couple the bottom surface to the top surface, the terminal electrodes are arranged in a direction in which a ridge of the flange at which the bottom surface and the outer end surface cross each other extends, each of the terminal electrodes includes a bottom portion that extends over the bottom surface from the ridge, and an outer portion that extends over the outer end surface from the ridge, and the flange further includes a recess between adjacent ones of the terminal electrodes, an outer end portion of the recess that is closer to the outer end surface is located in the outer end surface, and an inner end portion of the recess that is closer to the inner end surface is located in the bottom surface or located at a portion in the inner end surface closer to the bottom surface than the outer end portion of the recess.

2. The wound coil according to claim 1, wherein an end portion of the bottom portion of each of the terminal electrodes is located in the bottom surface, the inner end portion of the recess is located in the bottom surface, and an area of the bottom surface closer to the inner end surface forms a flat surface.

3. The wound coil according to claim 2, wherein, when each of the terminal electrodes is viewed in a direction perpendicular to the side surfaces, a ratio of a extending dimension of the outer portion of the terminal electrode to a extending dimension of the bottom portion of the terminal electrode is smaller than or equal to about 93%.

4. The wound coil according to claim 1, wherein:

each of the terminal electrodes further includes an inner portion extending over the inner end surface from the bottom portion of the terminal electrode, the inner end portion of the recess is located in the inner end surface, and when each of the terminal electrodes is viewed in a direction perpendicular to the side surfaces, a extending dimension of the inner portion of the terminal electrode is shorter than a extending dimension of the outer portion of the terminal electrode.

5. The wound coil according to claim 4, wherein, when each of the terminal electrodes is viewed in a direction perpendicular to the side surfaces, an end portion of the inner portion of each of the terminal electrodes is located outward of outer peripheral of the wires in a wound state.

6. The wound coil according to claim 1, wherein the recess is defined by a pair of inner side surfaces facing each other and perpendicular to the bottom surface and the outer end surface, and an inner bottom surface, coupling the pair of inner side surfaces.

7. The wound coil according to claim 6, wherein:

each of the terminal electrodes further includes an inner side portion extending over the inner side surface of the recess, and the terminal electrodes located at outermost further includes a side portion extending over the side surface of the flange.

8. The wound coil according to claim 7, wherein the inner side portions and the side portions of the terminal electrodes are triangular.

9. The wound coil according to claim 6, wherein the inner bottom surface of the recess is a flat and oblique surface to the bottom surface.

10. The wound coil according to claim 6, wherein the inner bottom surface of the recess is a surface set back inward.

11. The wound coil according to claim 1, wherein, when the wound coil is viewed in a direction perpendicular to the side surfaces, an extending dimension of the outer portion of each of the terminal electrodes is longer than a distance from the bottom surface of the flange to the wound core.

12. The wound coil according to claim 1, wherein, when the wound coil is viewed in a direction perpendicular to the side surfaces, an extending dimension of the outer portion of each of the terminal electrodes is longer than or equal to about 0.5 mm.

* * * * *